US006224442B1

(12) United States Patent
Simpson et al.

(10) Patent No.: US 6,224,442 B1
(45) Date of Patent: May 1, 2001

(54) RELEASE UNIT

(75) Inventors: James Arthur George Simpson, Amesbury; David Peter Plewka, Wimbourne, both of (GB)

(73) Assignee: Pains-Wessex Limited, Wiltshire (GB)

( * ) Notice: Subject to any disclaimer, the term of this patent is extended or adjusted under 35 U.S.C. 154(b) by 0 days.

(21) Appl. No.: 09/255,607

(22) Filed: Feb. 22, 1999

(30) Foreign Application Priority Data

Feb. 21, 1998 (GB) ..... 9803571

(51) Int. Cl.[7] ..... B63B 22/14
(52) U.S. Cl. ..... 441/10; 114/367
(58) Field of Search ..... 114/367, 221 A; 441/10; 89/1.14; 83/639.4; 102/392, 414, 428

(56) References Cited

U.S. PATENT DOCUMENTS

| | | | | |
|---|---|---|---|---|
| 2,926,565 | * | 3/1960 | Thorness . | |
| 3,885,484 | * | 5/1975 | Sturgis | 83/580 |
| 4,065,823 | | 1/1978 | Lorezen et al. | 9/9 |
| 4,079,364 | | 3/1978 | Antenore | 340/279 |
| 4,124,911 | | 11/1978 | Wildhagen | 9/33 |
| 4,499,844 | | 2/1985 | Parish | 114/367 |
| 4,976,317 | | 12/1990 | Leismer | 166/321 |
| 5,177,317 | * | 1/1993 | Walker et al. | 89/1.14 |
| 5,348,502 | | 9/1994 | Wigram | 441/7 |
| 5,365,873 | | 11/1994 | Wigram | 114/367 |
| 5,438,949 | | 8/1995 | Day | 114/367 |
| 5,573,343 | | 11/1996 | Davis et al. | 403/31 |

FOREIGN PATENT DOCUMENTS

| | | |
|---|---|---|
| 0 198 805 A1 | 10/1986 | (EP) . |
| 0 676 327 A1 | 10/1995 | (EP) . |
| 2272187 | 5/1994 | (GB) . |
| 2300874 | 11/1996 | (GB) . |
| WO 91/16233 | 10/1991 | (WO) . |
| WO 92/08641 | 5/1992 | (WO) . |
| WO 92/09473 | 6/1992 | (WO) . |
| WO 95/13957 | 5/1995 | (WO) . |

* cited by examiner

*Primary Examiner*—Ed Swinehart
(74) *Attorney, Agent, or Firm*—Heslin & Rothenberg, P.C.

(57) ABSTRACT

A device for releasing a link between a first object and a second object is disclosed. The device comprises a body having a holding means for securing the body to the link; a releasing means for releasing the link; a pyrotechnic composition for actuating the releasing means; an igniting means for igniting the pyrotechnic composition, the igniting means being activatable by an increase in ambient pressure; and a pressure-sensing means for detecting a change ambient pressure. In one embodiment, the device can include a sliding blade actuatable by a pyrotechnic composition that is ignited by an electrical stimulus activated by an increase in ambient pressure, and the link may be for example, a cable securing an emergency position indicating radio beacon to a watercraft. If the watercraft becomes submerged and the device is exposed to an increase in ambient pressure, the electrical stimulus will be activated to ignite the pyrotechnic composition which in turn, will actuate the sliding blade which then operates to cut the securing cable and release the EPIRB from the watercraft.

30 Claims, 2 Drawing Sheets

RELEASE UNIT

This application claims the priority of Great Britain patent application GB 9803571.0, filed Feb. 21, 1998, the entire disclosure of which is hereby incorporated by reference.

FIELD OF THE INVENTION

This invention relates to a device which releasably connects an ancillary unit to an object, such as, for example, a ship or an aircraft. More particularly, this invention relates to a hydrostatic release device.

BACKGROUND OF THE INVENTION

It is essential that ancillary equipment, such as for example, safety equipment such as life jackets, life buoys, life rafts and emergency position indicating radio beacons ("EPIRB"), are rapidly released when an object, such as a ship or aircraft sinks under water. During normal use however, the mechanism which retains an ancillary unit with an object, must be sufficiently strong and efficiently reliable in order that the ancillary unit will only be disengaged under the appropriate emergency conditions.

Typically, mechanisms for retaining and deploying ancillary units at sea have comprised a link which is secured at one part to the ancillary unit, and at another part to a release device which is associated with an object. Upon submergence, the release device triggers the release of the unit, for example by cutting the link connecting the device and the unit.

Hydrostatic release units are commonly used to trigger the release of safety equipment. Hydrostatic release units respond to the change in ambient pressure that occurs when they become submerged under water. Each unit has a pressure-sensing means, usually a pressure-sensitive diaphragm, that reacts to the increase in pressure and triggers the release of the ancillary unit.

EP-A-0676 327, for example, describes a hydrostatic release unit wherein a change in ambient pressure opens a liquid-filled chamber, thereby releasing a hydrostatic pressure behind a reciprocable member; as a result, the reciprocable member facilitates the release of an ancillary unit GB-A-2,300,874 describes a release unit wherein an increase in pressure triggers a pressure-sensitive spring mechanism to open a latch and release a life raft.

Similarly, U.S. Pat. No. 5,365,873 describes a mechanism wherein an increase in pressure results in the displacement of a slider which releases a life-raft or the like.

Another known hydrostatic release unit comprises a pressure-sensitive diaphragm which triggers a spring-loaded block. On release of the spring at a predetermined pressure, a blade cuts a rope which links the ancillary unit to the release device and the ancillary unit is then free to float to the surface. In an alternative mechanism, depression of a pressure-sensitive diaphragm allows water to flood into a compartment containing a soluble tablet which retains a releasing means, such as a blade for example, in position. Once the tablet has dissolved, the blade is released to sever the rope.

Most of the hydrostatic release units presently available, however, suffer from a number of disadvantages. The use of a soluble tablet for instance, can be unreliable and prone to accidental release under the typically moist and damp conditions that inevitably co-exist with seafaring vessels. Spring mechanisms also suffer detriment under moist conditions which may affect their mechanical operation. Moreover, larger and more powerful springs are needed in order to generate the force required to cut through increasingly thick linking ropes or ropes made from tougher material and the size of a hydrostatic release unit must be increased accordingly to accommodate the necessary increase in power required. This is increasingly impractical in light of the small size of life buoys and EPIRBs that are currently available.

SUMMARY OF THE INVENTION

It is an object of the present invention to provide a device for releasably linking an ancillary unit to an object, such as, for example, a ship or an aircraft, so that the ancillary unit is released when the object is submerged under water. It is also an object of the invention to provide a device that is simple to construct, economical to manufacture and highly reliable. It is a further object of the present invention to provide a device that is substantially resistant to the corrosive effects of sea water spray.

Accordingly, in one aspect, the invention provides a device for releasably connecting a first object to a link with a second object, such as an ancillary unit; the device comprising a body with holding means for securing the body to the link, and releasing means for releasing the link from the body, the releasing means being actuable in response to a change in ambient pressure; the device being characterized in that the releasing means is actuated by a pyrotechnic composition, igniting means being provided for igniting the pyrotechnic composition in response to a change in ambient pressure.

The first object may, for example, be a ship, an aircraft or any other object that has the potential to sink in water.

The second object (e.g., an ancillary unit) may for example, be such safety equipment as life jackets, life buoys, life rafts and emergency position indicating radio beacons (EPIRBs), or any other object that needs to be released upon submergence in an emergency situation.

The link between the first object and the second object (e.g., ancillary unit) may for example, be a securing bolt, a rope, a cable, or the like.

The releasing means may, for example, comprise a cutting mechanism, wherein activation of the releasing means severs the link to the second object. The releasing means may comprise a retractable means, wherein activation of the releasing means results in the retraction of a holding means, which may, for example, be a securing pin, a bolt, or the like, to release the link to the second object.

Accordingly, in one embodiment of the invention, the releasing means may comprise a cutting blade, which upon activation, cuts through the link. Preferably, the cutting blade has a curved or oblique cutting edge. Most preferably, the cutting blade has an oblique cutting edge, as this requires less force than a straightedged blade in order to provide the same cutting efficacy.

In a preferred embodiment, the releasing means may be a sliding member having a cutting blade at a leading end thereof. The sliding member may be moveable within a channel in the body, the channel lying between the igniting means and the link with the second object (e.g. an ancillary unit).

The sliding member may, for example, be a piston. It is preferred that the pyrotechnic composition is contained in a recess in the trailing end of the piston. The pyrotechnic composition may, for example, comprise gunpowder and a binding agent, such as, for example, nitrocellulose.

In a preferred embodiment, the piston contains a resilient seal about its perimeter. The resilient seal may for example, be an 'O'-ring seal, such as a plastics 'O'-ring, such as, for example, a Neoprene™ 'O'-ring. The 'O'-ring seal prevents the escape of noise or gas from the device and ensures that the body remains a sealed, non-hazardous unit.

The igniting means may, for example, take such forms as an electrical stimulus, a percussive stimulus, a piezoelectric stimulus, a friction-induced stimulus or a chemically-induced stimulus.

Accordingly, in one embodiment of the invention, the igniting means may, for example, be an electrical squib. The electrical squib may comprise a standard commercial Type A squib that comprises an insulating plate surrounded by two conducting plates that are joined by a bridging wire. Accordingly, the igniting means may be activated by electricity, for example, such as by an electrical circuit activated by a switch. In one embodiment, the switch may be activated by a pressure-sensing means wherein the pressure-sensing means detects changes in ambient pressure. Preferably, the switch is activated by an increase in pressure. Here, an increase in pressure causes the pressure-sensing means to activate the switch and thereby complete the electric circuit.

In one embodiment, the switch may be activated at a pressure corresponding to a depth of water of between about 1 and 4 meters. Clearly, devices adapted to operate at depths greater than 4 meters may be manufactured. While such devices would be less prone to accidental release, the increased depth that must be reached before release is initiated increases the time delay before actual release. Furthermore, there is a possibility that the device may fail to release at all at shallower depths.

Preferably, the pressure-sensing means comprises a diaphragm, wherein a change in ambient pressure results in a deflection of the diaphragm, which then serves to activate the switch.

Whilst it is desirable for the release mechanism to be sensitive to an increase in water pressure, the mechanism should be substantially immune to increases in atmospheric pressure, such as the changes in atmospheric pressure occurring as a result of changes in temperature. Therefore, it is preferred that a water-impermeable gas-vent equilibrates atmospheric pressure on both sides of the pressure-sensing means. Typically, the gas-vent is a porous plug, such as, for example, a porous glass plug. The plug ensures that the pressure-sensitive diaphragm can equilibrate with changes in ambient atmospheric temperature or barometric pressure and therefore prevent accidental release or inhibition of release.

In a particular embodiment, as the pressure increases with depth under water, the pressure-sensing means depresses the switch to complete the electric circuit. Preferably, the switch may comprise a commercially available miniature surface-mount switch. In a typical embodiment, once the pressure-sensing means depresses the switch, an electrical circuit is completed which may have a potential difference of between about 1 and about 50 V, for example, between about 1 and about 10 V, e.g., 3 V.

The holding means may, for example, be a conduit, a gripping means, a bolt, or the like. Preferably, the holding means for securing the body to the link with the second object (e.g., an ancillary unit) is a conduit through the body, whereby the link may pass freely through the conduit, which is in direct communication with the channel containing the releasing means.

One disadvantage of many known forms of hydrostatic release units is that sea spray may enter into the body via the conduit and enter the channel containing the releasing means. Trapped water may freeze solid and thereby result in the inactivity of the unit. Furthermore, in release devices that rely upon the dissolution of a soluble tablet, water may react with the tablet and result in premature disengagement of ancillary units. Thus, a preferred embodiment of the invention further includes a water-resistant, preferably waterproof, seal between the link with the ancillary unit and the conduit through the body. The water-resistant seal may, for example, take the form of a sleeve lining the conduit through the body. In this embodiment, the channel containing the release means remains dry even when the device is completely submerged. The release means, once activated, can cut through both the link and the water-resistant seal to release the body.

In a particularly preferred embodiment, the device comprises a body that is provided with holding means for securing the body to the link with an ancillary unit, and releasing means for releasing the link from the body, the releasing means being actuable in response to a change in pressure; the device being characterized in that a first compartment comprises a pressure sensing means and a switch activatable by the pressure-sensing means, the switch being operatively linked to an igniting means sited in a second compartment, the second compartment comprising a channel through which the releasing means is slidable, the releasing means containing, or having disposed adjacent thereto, a pyrotechnic composition; wherein a change in ambient pressure activates the switch, resulting in the igniting means detonating the pyrotechnic composition; the detonating of the pyrotechnic composition generating expansion of gas and forcing the releasing means to move along the channel and to sever the link between the body and the ancillary unit.

In another aspect, the principles of the present invention contemplate a first object releasably connected to a link with a second object, such as an ancillary unit, via a device as defined hereinabove.

In yet another aspect, the invention provides a method for releasably connecting a first object to a link with a second object, such as an ancillary unit. The method comprises anchoring the object to the link via a device as hereinbefore defined.

In still yet another aspect, the invention provides the use of a device as hereinbefore defined.

The advantages of using a release mechanism involving pyrotechnics are several. Firstly, it allows relatively simple manipulation of the required strength of the device, depending on the durability of the link between the object and the ancillary unit. Thus, for a relatively weak rope or cable, a small pyrotechnic detonation will suffice to produce enough force to sever the link. Conversely, for a strong rope or cable, the quantity or charge of pyrotechnic composition may be appropriately increased to produce a greater detonation force. Secondly, it permits a high-powered release mechanism to be accommodated in compact devices, by obviating the need to house large mechanical parts, e.g. large springs.

BRIEF DESCRIPTION OF THE DRAWINGS

The principles of the present invention will now be described, by way of example only, by reference to the accompanying drawings, in which.

DESCRIPTION OF THE PREFERRED EMBODIMENT

Figure 1:
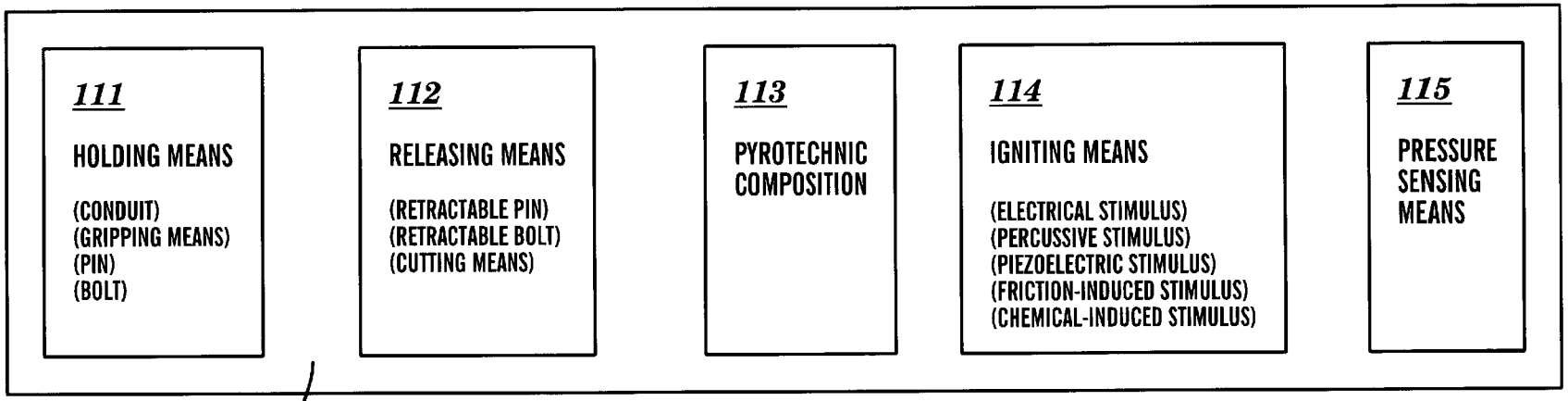
FIG. 1 is a block diagram representation of the release device of the present invention.
Figure 2:
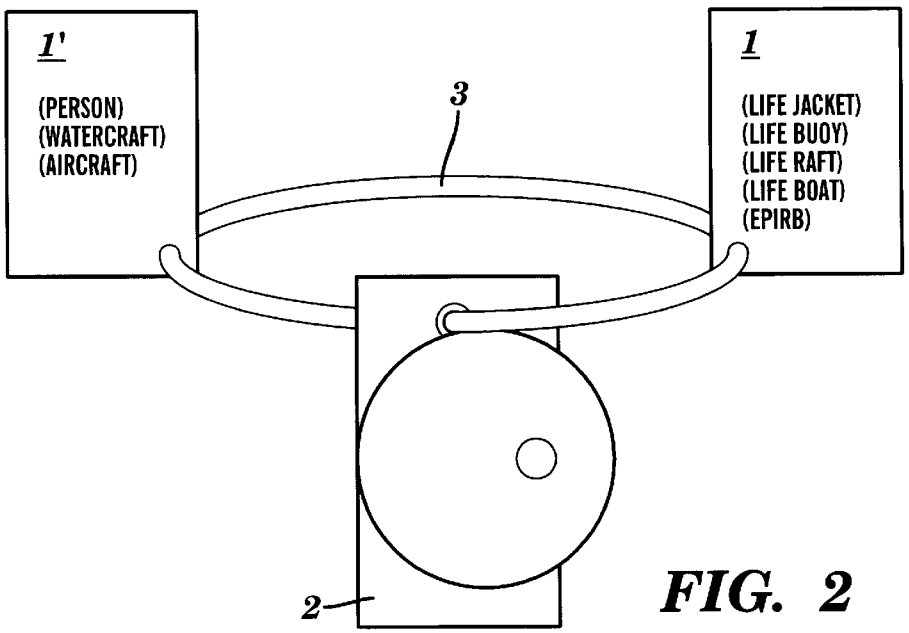
FIG. 2 is a schematic representation of one embodiment of the release device of the present invention connected to a link between a first object and a second object.

FIG. 1 is a block diagram representation of the components of the release device of the present invention. As is depicted in FIGS. 1 and 2, the release device 2 comprises a body 2' having holding means 111 for securing the device 2 to a link 3 between a first object 1' and a second object 1; releasing means 112 for releasing the link 3 from the device 2; a pyrotechnic composition 113 for actuating the releasing means; an igniting means 114 for igniting the pyrotechnic composition, the igniting means being activatable by an increase in ambient pressure; and a pressure-sensing means 115 for detecting a change ambient pressure. One embodiment of the device of FIG. 1 is illustrated in detail in FIGS. 2, 3 and 4.

FIG. 2 depicts an embodiment of the release device of FIG. 1 connected to a link 3 between a first object 1' and a second object 1. As illustrated, the first object 1' may, for example, be a person, a watercraft or an aircraft; the second object may for example, be a life jacket, a life buoy, a life raft, a life boat or an emergency position indicating radio becon (EPIRB); and link 3 may be a cable or a rope. This embodiment is illustrated in particular detail in FIGS. 3 and 4.

The release device of the present invention has a body 2' made from a suitable material, such as a moldable plastics material, or the like. The material should be strong enough to withstand the detonation of a pyrotechnic composition, it should be non-porous and chemically non-reactive (i.e., non-reactive to water, oils or detergent), and it should be suitable to withstand extremes of temperature, for example, temperatures in the range of minus 30° C. to plus 70° C. The device may be formed, for example, from high-impact plastics, for example, ABS, or a glass filled nylon. In addition, the body may be sprayed with a suitable protective varnish or coating.

Figure 3:
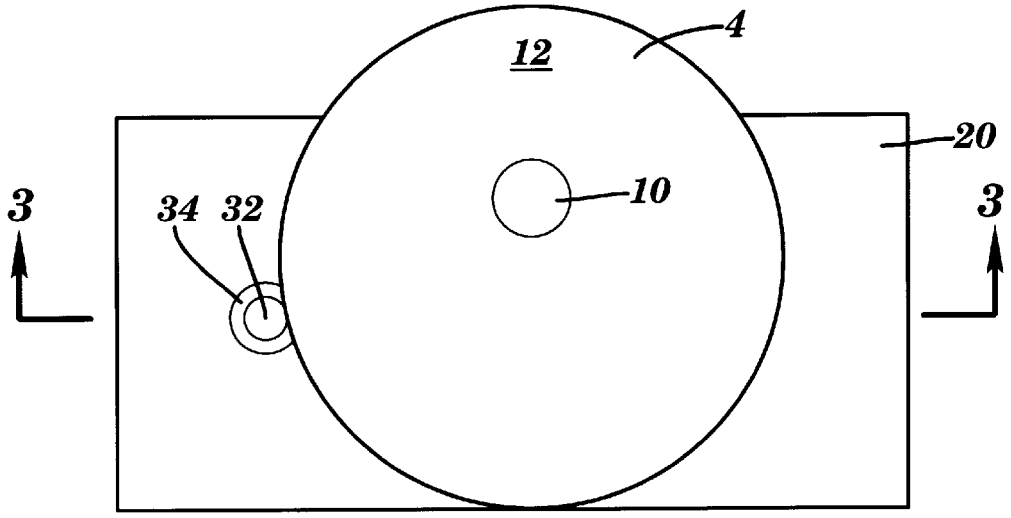
FIG. 3 is a top plan view of the release device of FIG. 2.
Figure 4:
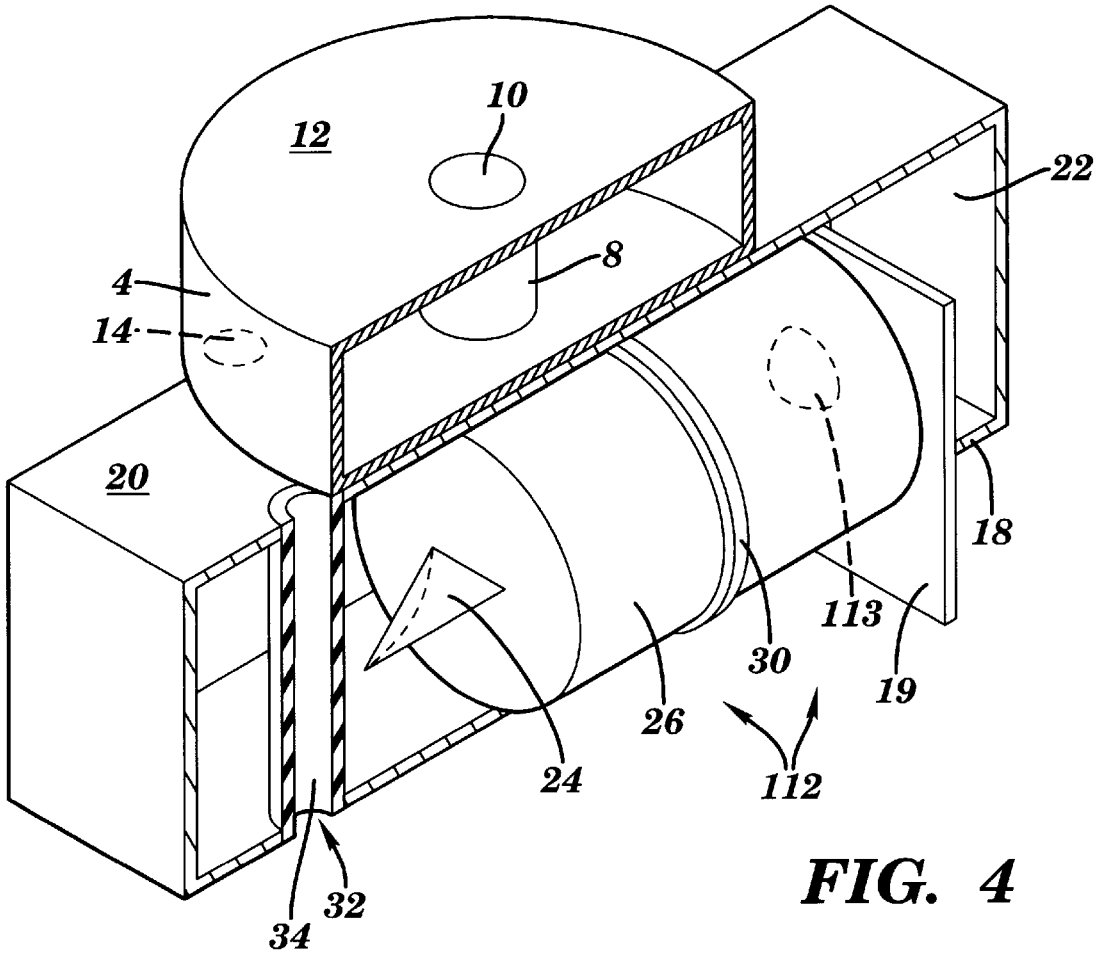
FIG. 4 is an isometric view of the release device of FIG. 2 taken along line 3—3 of FIG. 3.

Referring now to FIGS. 3 and 4, the body 2' of the release device 2 contains a first and a second compartment. The first compartment 4 contains a pressure-sensing diaphragm (not shown) mounted above a recess containing a miniature surface-mount switch 8. It is advantageous to keep the volume of the recess as large as possible to ensure efficient operation of the release device.

A hole 10 in a cap 12 of the first compartment allows the diaphragm to respond to an increase in pressure if the device is submerged and encounters pressures higher than atmospheric pressure.

A plug, such as, for example, a porous glass plug, 14 at the base of the first compartment, allows the compartment to equilibrate with variations in atmospheric pressure.

In the embodiment illustrated, the mount switch 8 is connected via a lithium battery to an electric squib (schematically depicted as 19) which is sited at one end 18 of the second compartment 20. The squib may be maintained in position using an epoxy or silicon resin, or the like.

The second compartment 20 contains a channel 22. Within the channel 22 is disposed a releasing means 112, which in the particular embodiment illustrated, comprises a cutting blade 24 mounted on a piston 26 which is slidable in either direction. In a recess at the trailing end of piston 26, there is contained a charge (e.g., approximately 60 mg) of a pyrotechnic composition 113. The pyrotechnic composition 113 may, for example, comprise a mixture of gunpowder and a binding agent such as nitrocellulose. The invention, is not, however, intended to be limited to such a composition, and any pyrotechnic or propellant charge will suffice.

Cutting blade 24 may have an oblique (shown) or curved (shown in dashed lines) cutting edge and may be manufactured from any suitable material, such as, for example, a carbon steel, stainless steel, or the like. Typically, the piston 26 and other structural parts of the device may be made from the same material as body 2', for example, a suitable moldable plastic.

The circumference of piston 26 is preferably surrounded by a resilient seal, illustrated in FIG. 4 as an 'O'-ring seal 30 downstream of pyrotechnic composition 113. Typically, resilient 'O'-ring seal 30 comprises a plastics 'O'-ring, such as, for example, a Neoprene™ 'O'-ring. The resilient seal 30 prevents the escape of noise or gas resulting from the detonation of pyrotechnic composition 113 and ensures that release device 2 remains a sealed, non-hazardous unit.

Second compartment 20 additionally comprises a conduit 32 downstream of the release means which retains rope 3, the link to first object 1' and second object 1. A waterproof seal 34 within the conduit 32 with body 2' of release device 2, provides an interface to prevent water from entering body 2' from the outside.

Once the pressure-sensing diaphragm mounted over switch 8 is depressed by the weight of the water pressure on submergence of the device, it activates the miniature surface-mount switch 8 which is connected via an electrical circuit to the electrical squib 19. On activation, the squib 19 ignites pyrotechnic composition 113 at the trailing end of piston 26 which is in close proximity with the electrical squib. The heat from the detonation of the pyrotechnic composition 113 produces gas which forces the cutting blade 24 to move down the channel 22 and away from the electrical squib 19. Hence, the piston 26 forces the cutting blade 24 to cut through the link (i.e., rope 3) attached to the first object 1' and the second object 1; the second object 1 is liberated and floats to the surface.

The illustrated embodiment provides a significant advantage in that the size and composition of pyrotechnic composition 113 may be readily adjusted to take into account the thickness of rope 3 and the toughness of the material from which it is made. This can be accomplished with minimal or no alterations to the structure of release device 2, which is in contrast to spring-loaded devices in which adjustment of the size and force of the spring would typically necessitate significant changes to the size of the device.

Accordingly, as illustrated by the foregoing description of the preferred embodiment, the principles of the present invention provide, but are not limited to:

It should be understood that while this invention has been described herein in terms of specific embodiments set forth in detail, such embodiments are presented by way of illustration only, and the invention is not necessarily limited thereto. Modifications and variations in any given material will be readily apparent to those skilled in the art without departing from the true spirit and scope of the following claims, and all such modifications and variations are intended to be within the scope of the present invention.

What is claimed is:

1. A device for releasing a link between a first object and a second object, the device comprising a body, the body including holding means for securing the body to a link between a first object and a second object, releasing means for releasing the link, a pyrotechnic composition for actuating the releasing means, and igniting means for igniting the pyrotechnic composition, the igniting means being activatable by an increase in ambient pressure.

2. A device according to claim 1, wherein the first object is a person, a watercraft or an aircraft.

3. A device according to claim 2, wherein the second object is a life jacket, a life buoy, a life raft, a life boat or an emergency position indicating radio beacon.

4. A device according to claim 1 wherein the link comprises a securing pin, a rope or a cable.

5. A device according to claim 4, wherein the releasing means comprises a retractable pin or bolt.

6. A device according to claim 4, wherein the releasing means comprises a cutting means.

7. A device according to claim 6, wherein the cutting means is a blade.

8. A device according to claim 7, wherein the blade has a curved or oblique cutting edge.

9. A device according to claim 8, wherein the blade has an oblique cutting edge.

10. A device according to claim 6, wherein the body further comprises a channel from the igniting means to the link and the cutting means is a sliding member disposed within the channel, the sliding member having a blade on an end thereof proximate the link.

11. A device according to claim 9, wherein the sliding member is a piston.

12. A device according to claim 11, wherein the pyrotechnic composition is contained within a recess in an end of the piston proximate the igniting means.

13. A device according to claim 12, further comprising a resilient seal about the circumference of the piston.

14. A device according to claim 13, wherein the resilient seal is an 'O'-ring seal.

15. A device according to claim 1, wherein the pyrotechnic composition comprises gunpowder and a binding agent.

16. A device according to claim 1, wherein the igniting means is chosen from an electrical stimulus, a percussive stimulus, a piezoelectric stimulus, a friction-induced stimulus and a chemically-induced stimulus.

17. A device according to claim 16, wherein the igniting means is an electric stimulus.

18. A device according to claim 17, wherein the electrical stimulus is an electrical squib.

19. A device according to claim 17, wherein the igniting means is actuated by a switch activated by a pressure-sensing means.

20. A device according to claim 19, wherein the pressure-sensing means activates the switch at a pressure corresponding to a depth of water between 1 and 4 meters.

21. A device according to claim 19, wherein the pressure-sensing means is a diaphragm.

22. A device according to claim 21, further comprising a water-impermeable gas-vent.

23. A device according to claim 22, wherein the water-impermeable gas vent is a porous plug.

24. A device according to claim 23, wherein the porous plug is a porous glass plug.

25. A device according to claim 2, wherein the holding means for securing the body to the link comprises a gripping means, a bolt or a conduit through the body.

26. A device according to claim 25, wherein the holding means is a conduit and the link passes therethrough.

27. A device according to claim 26, further comprising a water resistant seal between the link and the conduit.

28. A device according to claim 27, wherein the water resistant seal comprises a sleeve lining the conduit.

29. A method for releasably linking a second object to a first object, said method comprising securing a second object to a first object with a link having a device according to claim 2 secured thereto.

30. A device for releasing a link between a first object and a second object, the device comprising a body, the body including holding means for securing the body to a link between a first object and a second object, releasing means for releasing the link, a pyrotechnic composition for actuating the releasing means, igniting means for igniting the pyrotechnic composition, a switch for activating the igniting means, and a pressure-sensing means for activating the switch, wherein an increase in ambient pressure detected by the pressure-sensing means activates the switch, which in turn activates the igniting means, which in turn detonates the pyrotechnic composition, which in turn actuates the releasing means, which in turn releases the link and the first and second objects are separated.

* * * * *